US005366606A

United States Patent [19]

Tarancon

[11] Patent Number: 5,366,606

[45] Date of Patent: Nov. 22, 1994

[54] ELECTROLYTIC GAS GENERATOR

[75] Inventor: Gregorio Tarancon, High Springs, Fla.

[73] Assignee: Florida Scientific Laboratories Inc., High Springs, Fla.

[21] Appl. No.: 63,943

[22] Filed: May 17, 1993

[51] Int. Cl.[5] ..... C25B 9/00; C25B 11/02; C25B 15/08

[52] U.S. Cl. ..... 204/257; 204/258; 204/263; 204/266; 204/265; 204/292; 204/293; 204/296

[58] Field of Search ..... 204/256, 258, 266, 270, 204/292, 293, 294, 296, 257, 263-265

[56] References Cited

U.S. PATENT DOCUMENTS

| | | | |
|---|---|---|---|
| 3,930,151 | 12/1975 | Shibata et al. | 204/258 |
| 4,059,500 | 11/1977 | Kamarian | 204/258 X |
| 4,377,455 | 3/1983 | Kadija et al. | 204/258 X |
| 4,469,577 | 9/1984 | Schmitt et al. | 204/258 X |

*Primary Examiner*—Donald R. Valentine
*Attorney, Agent, or Firm*—Ezra Sutton

[57] ABSTRACT

The present invention provides an electrolytic gas generator for generating fluorine and other chemicals and more particularly, to a more efficient electrolyzer having reduced resistance between the cathode and anode and which prevents the migration of gas between the anode compartment and the cathode compartment.

24 Claims, 8 Drawing Sheets

ELECTROLYTIC GAS GENERATOR

FIELD OF THE INVENTION

The present invention provides an electrolytic gas generator for generating fluorine and other chemicals and, more particularly, to a more efficient electrolyzer having reduced resistance between the cathode and anode and which prevents the migration of gas between the anodic compartment and the cathodic compartment.

BACKGROUND OF THE INVENTION

Of the many types of electrolyzers that are commercially used for manufacturing fluorine and other chemicals, they all are subject to problems with respect to either reduced efficiency due to resistance between the cathode and anode or gas migration from one electrode compartment to the other electrode compartment.

The state of the art in the area of fluorine electrolyzers provides proof that the decrease of resistance between the cathode and the anode provides a positive effect on the efficiency of the electrolyzer because of the reduction on power consumption. As the resistance decreases, the overvoltage is decreased proportionally, which is a reduction on power.

Accordingly, one object of the present invention is to provide an improved electrolyzer for manufacturing fluorine and other chemicals that provides improved efficiency by reducing the resistance between the anode and the cathode.

It is a further object of the present invention to provide an electrolyzer that has improved safety due to a reduction of gas diffusion between the anode compartment and the cathode compartment in each direction, by employing an electrolyte-feeding compartment having a double diaphragm with a cavity therebetween at higher pressure than the adjacent cathode compartment and at higher pressure than the adjacent anode compartment.

It is a further object of the present invention to provide an electrolyzer with a membrane and electrode compartments (cathode and anode) independent of the gas compartments.

It is another object of the invention to provide electrode zones, anodic and cathodic, with multi-electrode elements.

It is another object of the invention to provide electrode elements disposed at an angle to direct the flow of molecular fluorine gas in an opposite direction to molecular hydrogen gas.

It is another object of the invention to provide total insulation between the fluorine side and the hydrogen side of the electrolyzer (electrical insulation and diffusional insulation.

SUMMARY OF THE INVENTION

In accordance with the present invention, there is provided an electrolytic gas generator having: a cathode compartment for receiving electrolyte having a first side and a second side a first plurality of cathode electrodes disposed at an angle beta relative to the first side, a second plurality of cathode electrodes disposed at an angle beta relative to the second side, and a cathode gas-receiving zone disposed above he cathode electrodes; a first anode compartment for receiving electrolyte adjacent to the first side, a first plurality of anode electrodes disposed at an angle alpha relative to the first side, and a first anode gas-receiving zone disposed above the first plurality of anode electrodes; a second anode compartment for receiving electrolyte adjacent to the second side, a second plurality of anode electrodes disposed at an angle alpha relative to the second side, and a second anode gas-receiving zone disposed above the second plurality of anode electrodes; a first electrolyte-feeding compartment disposed between the cathode compartment and the first anode compartment, and a second electrolyte-feeding compartment disposed between the cathode compartment and the second anode compartment, for supplying electrolyte to the cathode compartment and to the first and second anode compartments; each of the first and second electrolyte-feeding compartments having an electrolyte-feeding chamber for holding electrolyte therein under pressure to form a pressurized electrolyte-feeding chamber, a cathode membrane through which the electrolyte under pressure passes to the cathode compartment to react with the cathode electrodes, and an anode membrane through which the electrolyte under pressure passes to one of the first and second anode compartments; and apparatus for maintaining under pressure the electrolyte within the first and second electrolyte-feeding chambers, so that the pressure therein is higher than the pressure in the cathode compartment and the first and second anode compartments.

The electrolytic gas generator of the present invention also provides cathode electrodes formed of flat steel bars and produce molecular hydrogen gas and anode electrodes formed of a nickel alloy and produce molecular fluorine gas.

BRIEF DESCRIPTION OF THE DRAWINGS

Further objects, features, and advantages of the present invention will become apparent upon consideration of the detailed description of the presently-preferred embodiment, when taken in conjunction with the accompanying drawings wherein.

DETAILED DESCRIPTION OF THE PREFERRED EMBODIMENT

Figure 1:
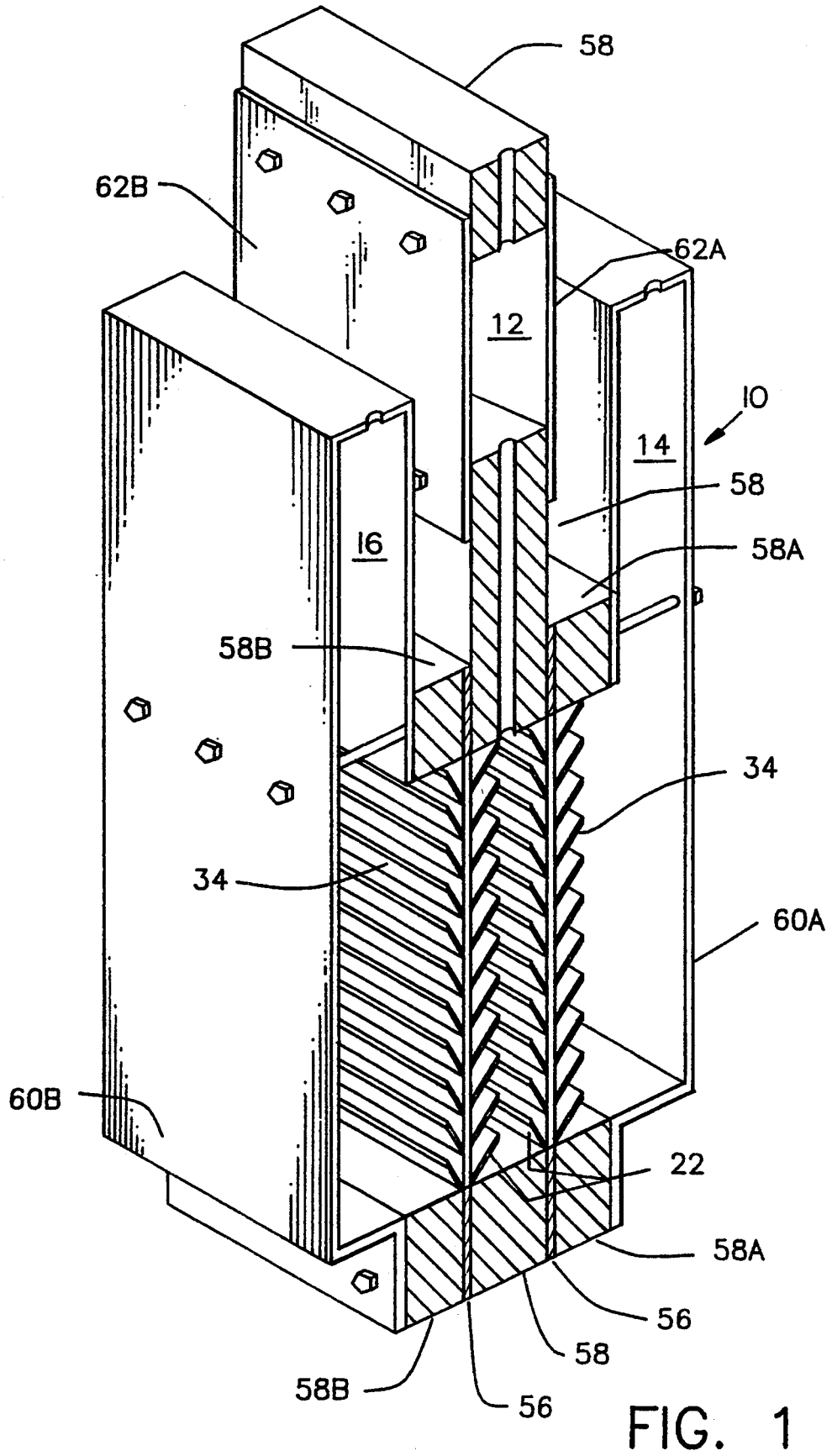
FIG. 1 is a perspective view of the electrolyzer of the present invention.
Figure 2:
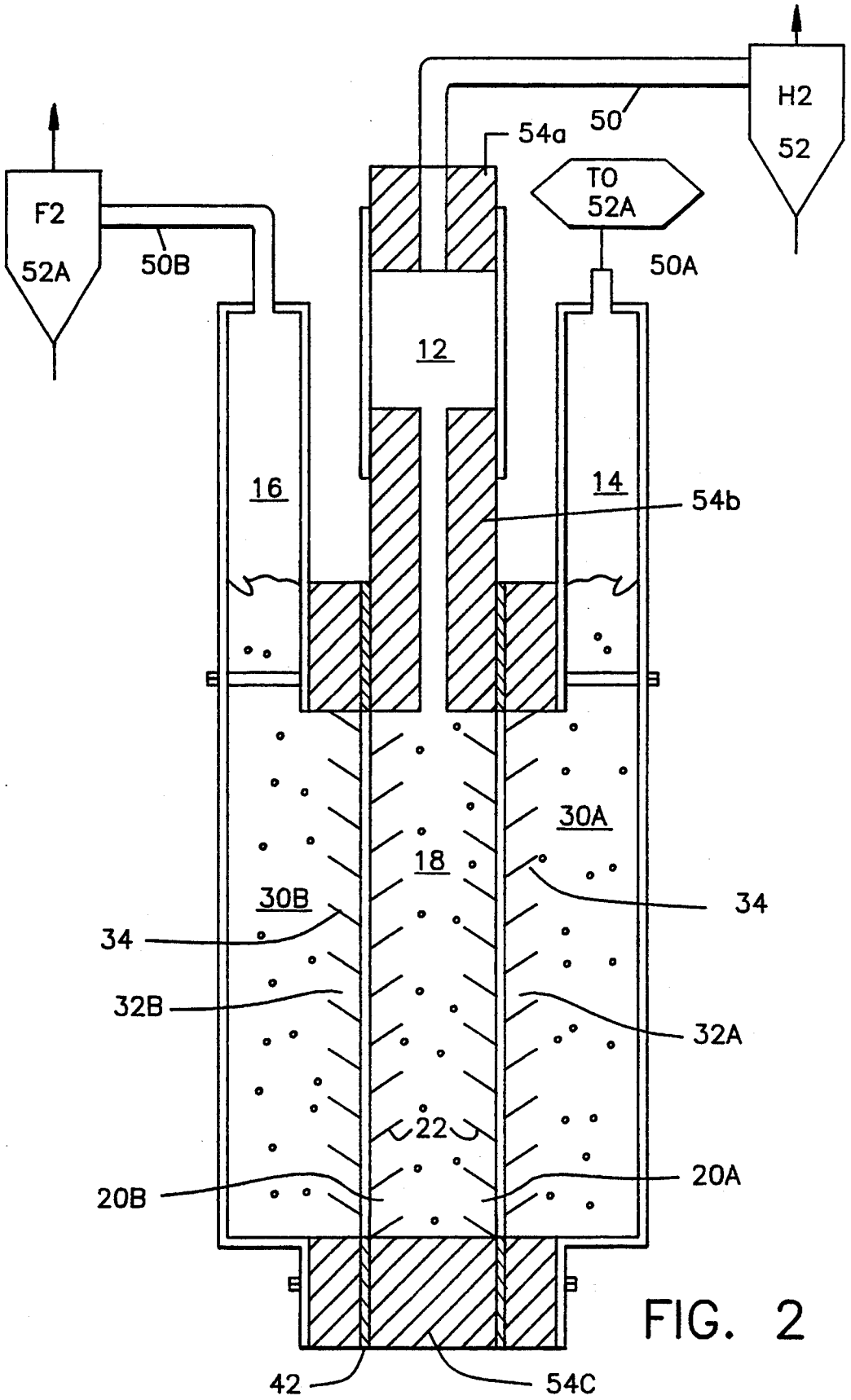
FIG. 2 is a sectional view thereof.

FIGS. 1 and 2 show the new gas electrolyzer 10, which is an electrochemical reactor and is illustrated as a fluorine generator. There are three gaseous compartments, a hydrogen gas compartment 12, and two fluorine gas compartments 14 and 16. The cathode compartment includes the hydrogen gas compartment 12, which is disposed vertically above the electrolyte solution of the hydrogen release zone 18, which is in between the two cathode zones 20A for the right side and 20B for the left side. The cathode zones 20A and 20B include multi-electrode cathode elements 22. On the surface of the cathode elements 22, the hydrogen is liberated. The cathode elements 22 preferably are made of steel flat bars.

Figure 6A:
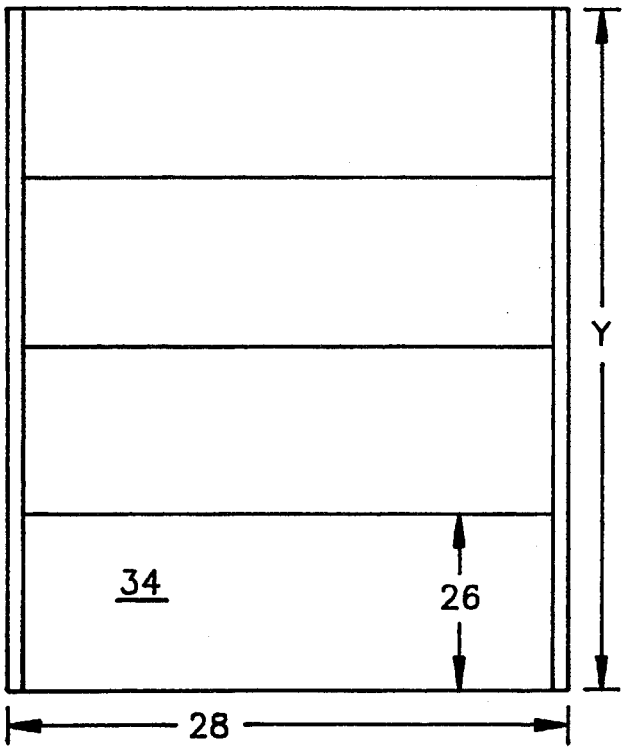
FIG. 6 illustrates the electrodes.
Figure 6B:
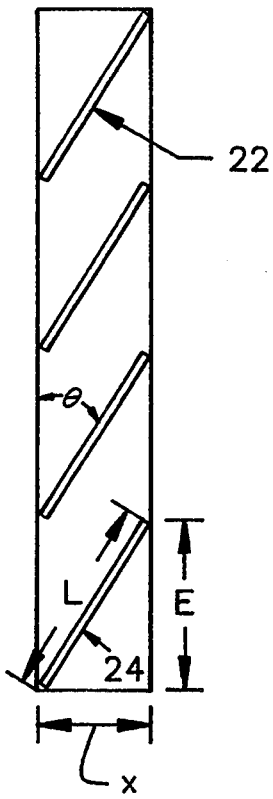
Figure 6C:
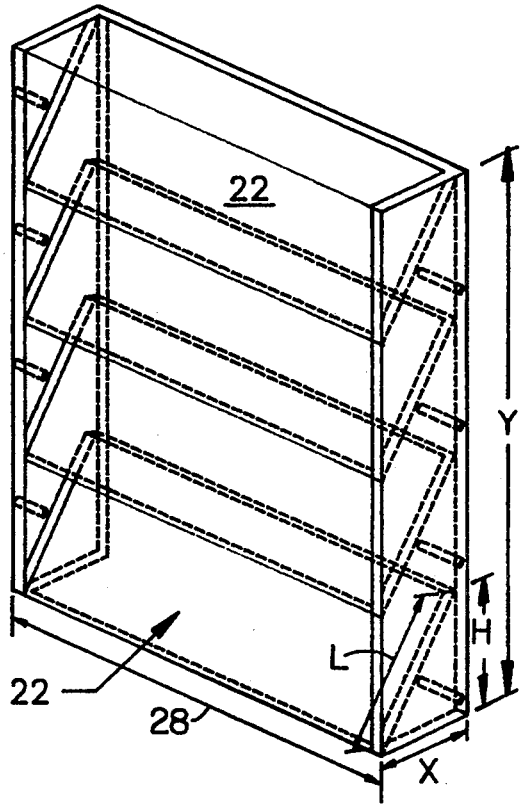

FIG. 6 illustrates the cathode electrode elements 22, and each one preferably has the following dimensions: the wall thickness 24, in the range of from 1 mm to 10 cm, the width 26, in the range from about 1 cm to about 10 cm, and the length 28, in the range from about 0.1 m to about 10 m. In the preferred embodiment the dimensions are: wall thickness from 1 mm to 5 mm but preferably about 3 mm; the width from 2 cm to 6 cm but preferably about 4 cm; and the length from 0.5 m to 5 m but preferably about 2 m.

FIG. 2 also illustrates the anode compartments, which include the fluorine gas compartments 14 and 16, which are disposed vertically above the electrolyte solution of the fluorine release zones 30A on the right side and 30B on the left side. One fluorine gas compartment 14 is on the right side of the electrolyzer 10, above the fluorine release zone 30A, and the fluorine gas compartment 16 is on the left side of the electrolyzer 10, above the fluorine release zone 30B. The anode zone 32A is side by side with the fluorine release zone 30A, in the right side of the electrolyzer 10, and the anode zone 32B is side by side with the fluorine release zone 30B. The anode zones 32A and 32B include multi-electrode anode elements 34. On the surface of he anode elements 34, the fluorine gas is liberated. The anode electrode elements 34 preferably are made of flat bar nickel or nickel alloy because they are inert metal to elemental fluorine gas. FIG. 6 illustrates the anode electrode elements 34, which preferably have the following dimensions: the wall thickness 36, in the range of from 1 mm to about 10 mm, the width 38, in the range from 1 cm to about 10 cm, and the length 40, in the range from 0.1 m to about 10 m.

Figure 4:
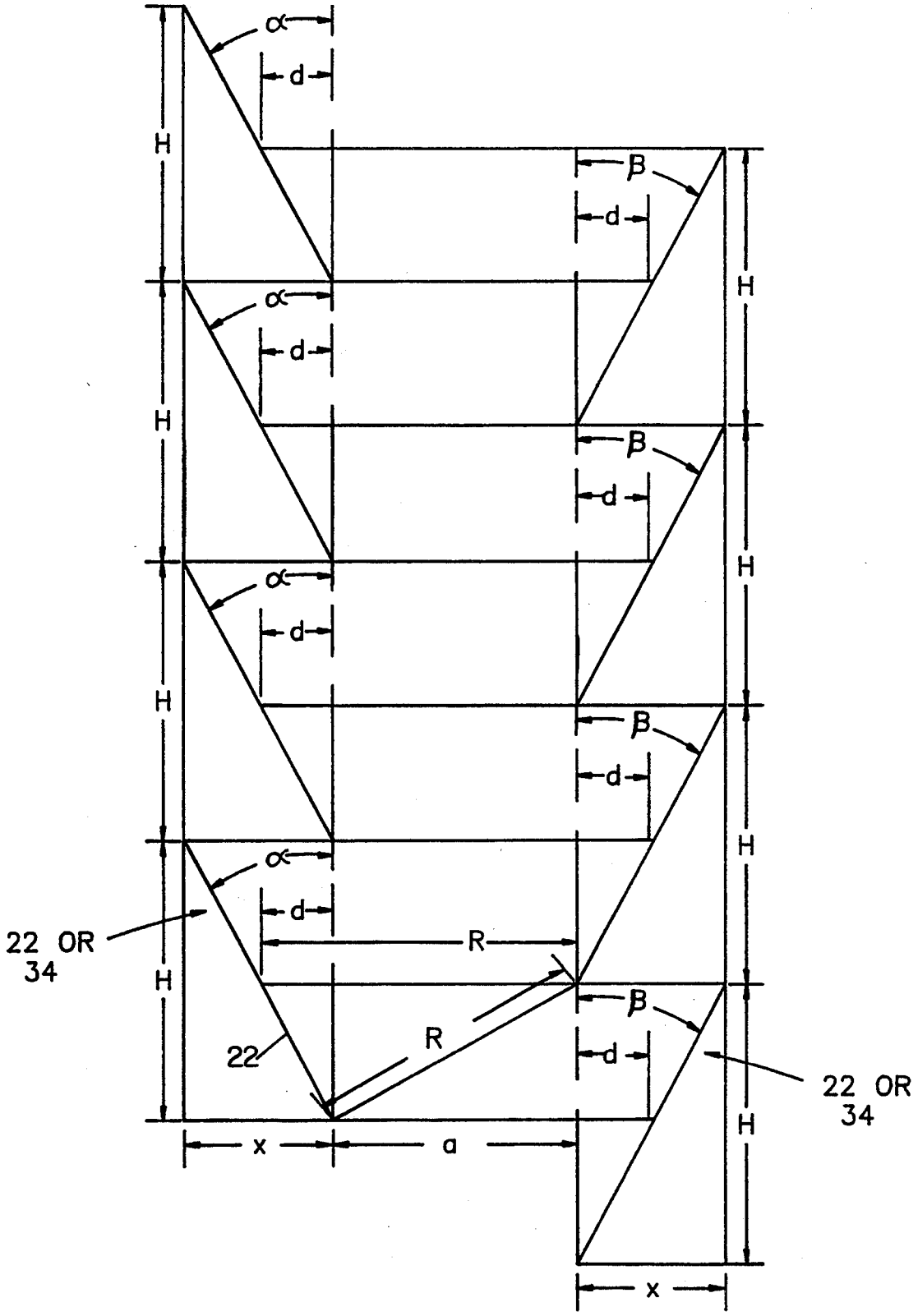
FIG. 4 illustrates the angular arrangement of the anodes and cathodes.

FIG. 4 illustrates the disposition of the electrodes in the electrolyzer 10, anode electrode elements 34, and cathode electrode elements 22, which normally have the same dimensions, but they are different in the following respects: relative position with respect to the elevation, material of construction, and angle.

Figure 3:
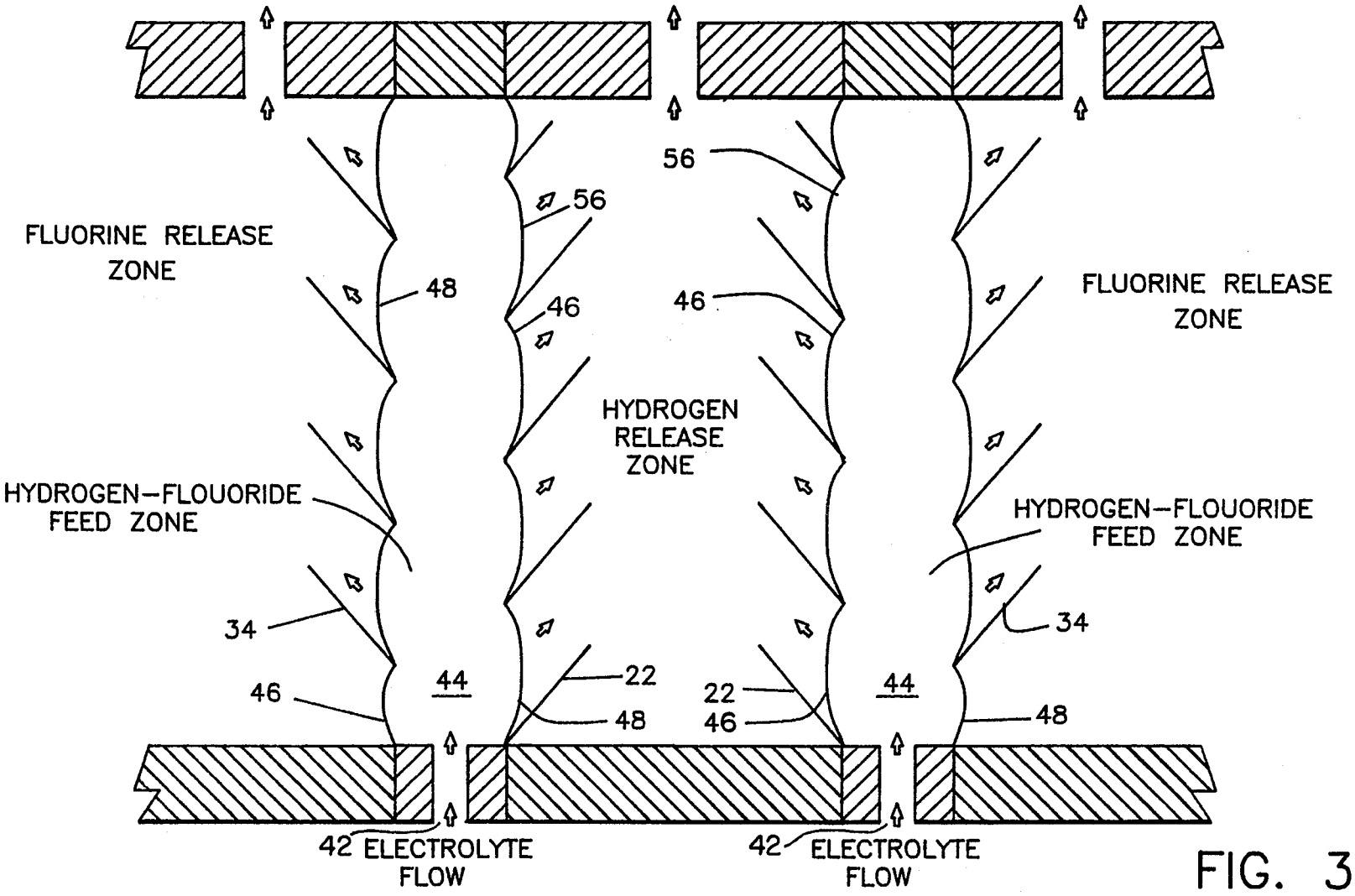
FIG. 3 is a diagrammatic representation of the electrolyte-feeding compartments disposed between the anode and cathode compartments.

FIG. 3 illustrates the inlet port where anhydrous liquid hydrogen fluoride is introduced by a metering device 42 to each cavity 44 between the double membranes 46 and 48. FIG. 2 illustrates the hydrogen stream 50, and the fluorine streams 50A and 50B. These are piped to the electrolyte entrainment separators 52, for the hydrogen and electrolyte entrainment separator 52A for the fluorine, necessitated by electrolyte carryover due to gas breakout from the surface of the electrolyte, pressure surges, and a small amount of hydrogen fluoride mist normally entrained.

Figure 7:
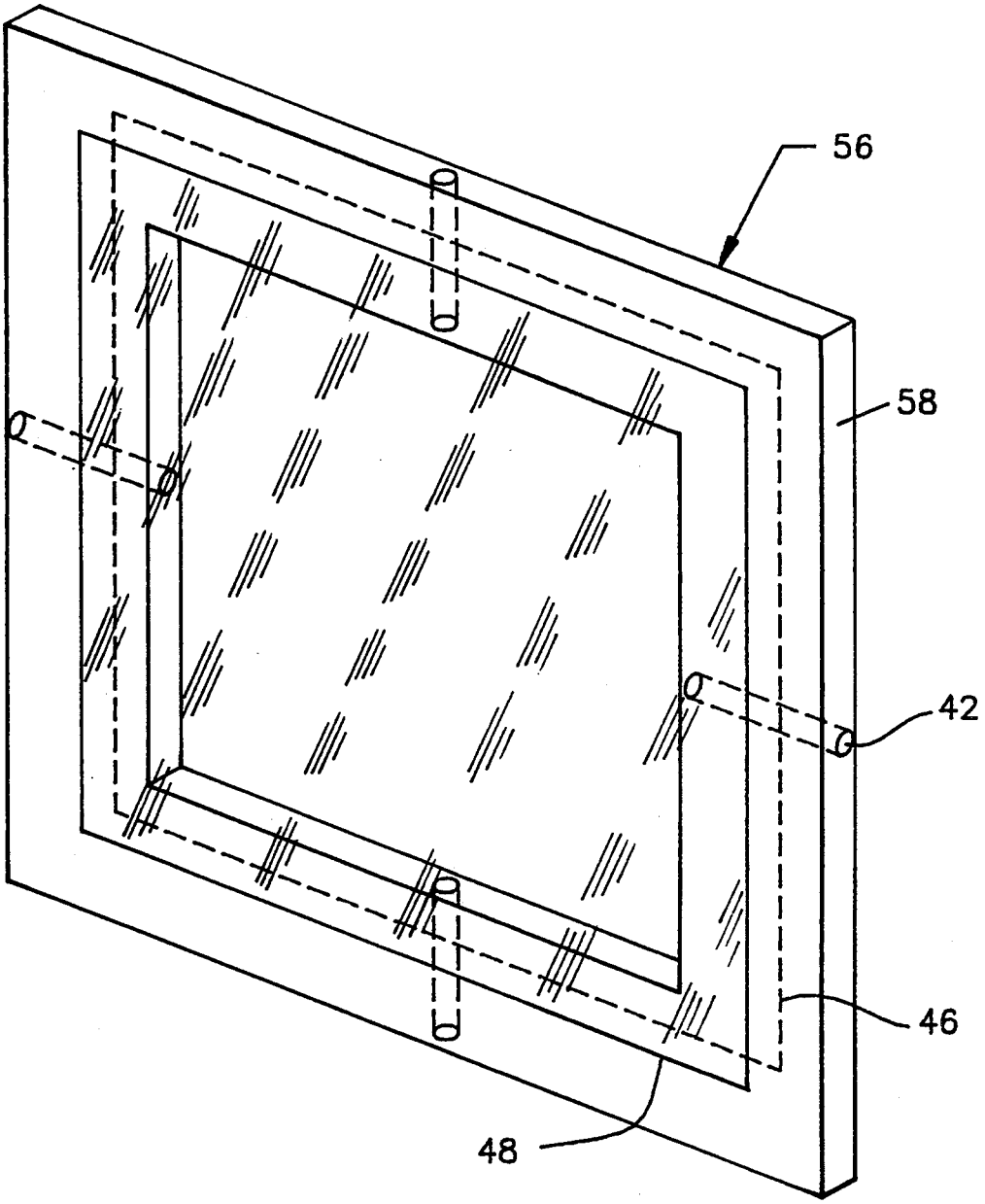
FIG. 7 is a detailed perspective view of an electrolyte-feeding chamber having a membrane on both sides thereof.

FIG. 7 illustrates the membrane assembly 56, where the cathode membrane 46 and the anode membrane 48 are parallel, one opposite to the other and consist of screen diaphragms. The diaphragm or membrane assembly 56 is a perfluorinated membrane 46 and 48, attached to the electrical insulator 58.

FIG. 1 illustrates that the electrolyzer 10 has two steel plates 60A and 60B for the fluorine side, that are sealed tight to prevent leaks to the environment, and two steel plates 62A and 623. The enclosure of the electrolyzer 10 is the insulators 58, 58A, and 58B, the two steel plates 60A and 60B, and the two steel plates 62A and 62B. The two steel plates 60A and 60B are part of/or connected to the anode electrode, and the steel plates 62A and 62B are oat of the hydrogen compartment.

Figure 8:
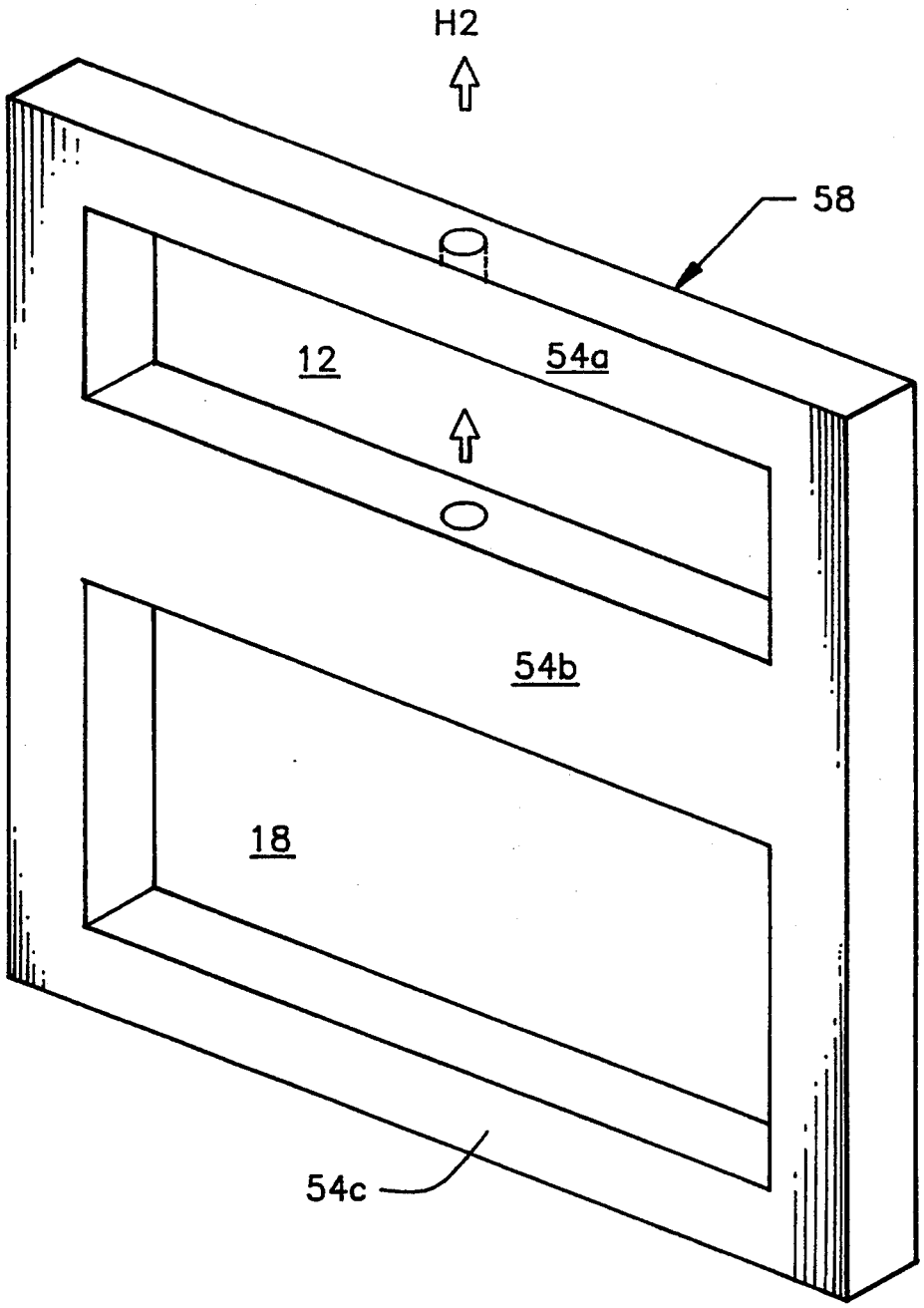
FIG. 8 is a perspective view of an electric insulator.

FIG. 8 illustrates the electrical insulator 58 between the anode electrode side and the cathode electrode side. The electrical insulator 58 has a diaphragm 54 between the hydrogen compartment and the hydrogen release zone. The fluorine compartments 14 and 16, and the sealer to the fluorine compartments, are attached to the insulator 58.

U.S. Pat. No. 4,950,370 entitled: "Electrolytic Gas Generator," and issued Aug. 21, 1990, discloses a method and apparatus for the production of fluorine and hydrogen. This invention is an improvement of U.S. Pat. No. 4,950,370 because it provides increased efficiency and upgrades the safety of the process. One improvement is the enlargement of the electrolyte compartment without sacrificing the distance between the electrodes (cathode and anode). This invention decreases the distance between the electrodes, with the benefit of reducing the electrical resistance and with a significant reduction of the voltage across the electrolyte between the two electrodes (cathode and anode). The heat generation is decreased abut 50% compared to the abovementioned patent and over 100% compared with the prior art.

The new electrode design is a parallel series of flat bars for the cathode electrode elements 22 and for the anode electrode elements 34. The flat bars are fabricated of steel or copper for the cathode, and monel or nickel for the anode, but other materials, such as carbon or platinum, may be used. The thickness of the flat bars is from about 1 mm to 10 mm and, preferably, about 2 mm to 4 mm. The width of the bars is from 1 cm to 10 cm, preferably about 2 cm to 6 cm.

Figure 5:
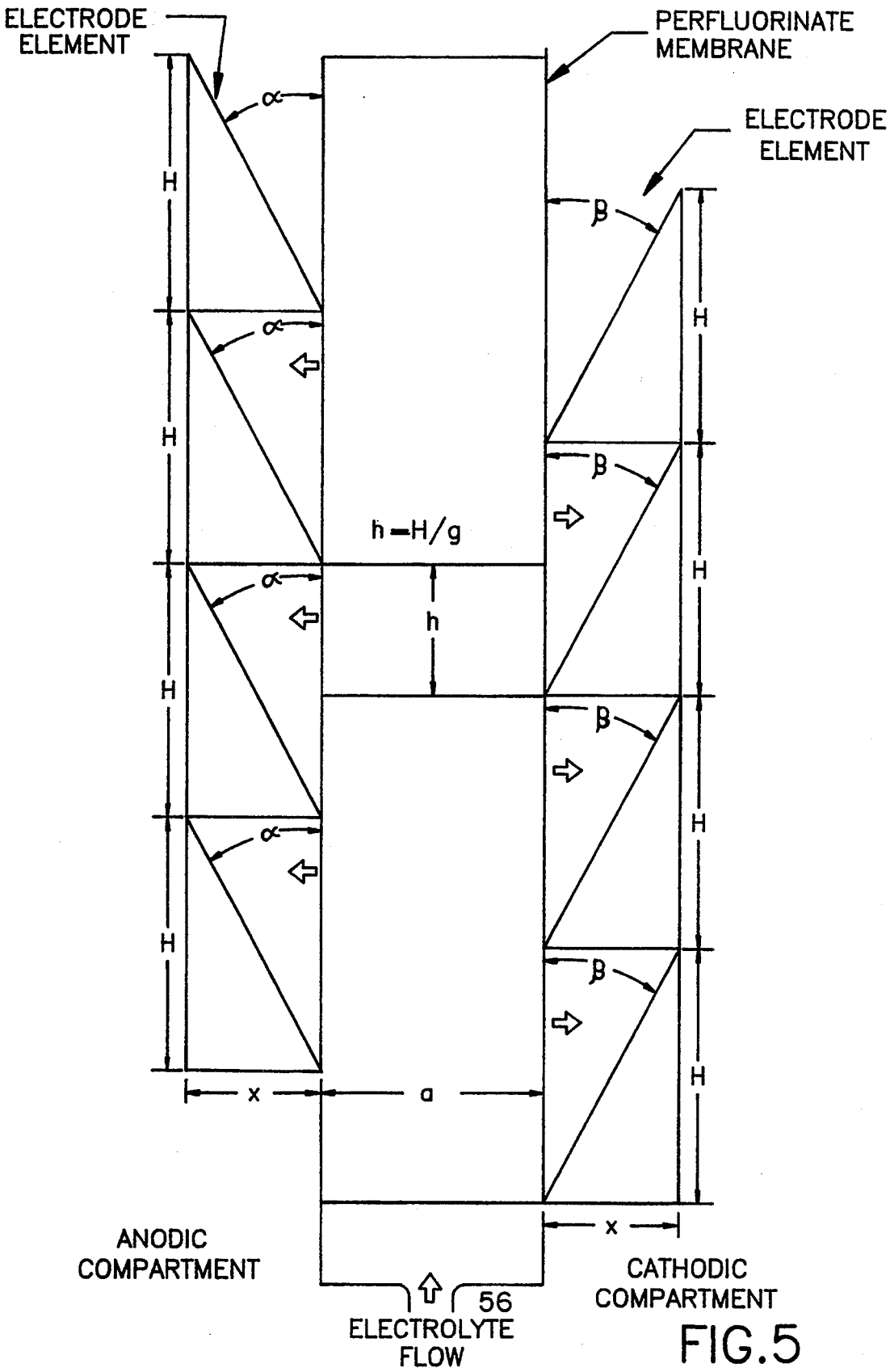
FIG. 5 illustrates the angular arrangement of the anodes and cathodes relative to the anode and cathode membranes.

FIGS. 4 and 5 illustrate the angle of inclination of the flat bars with respect to the angle of repose, which is in the vertical position. FIG. 3 illustrates side A and side B of the electrolyzer 10. In side A, the anode electrode elements are in the range of 10° to 75° with respect to the angle of repose or the vertical axis. The cathode electrode elements are also in the range of 15° to 75° with respect to the angle of repose or the vertical axis. The cathode electrode elements are also in the range of 15° to 75° and the cathode electrode elements are in the range of 15° to 75° with respect to the angle of repose or the vertical axis.

FIG. 3 illustrates the perfluorinated bag membrane 56, which provides the advantage of keeping the electrode distances to a minimum and, at the same time, prevents gas from passing between the anode compartment and the cathode compartment. The bag membrane 56 is a double membrane 46 and 48 with a cathode membrane surface and an anode membrane surface 48. The chamber or cavity 44 between the membrane on the cathode side and the membrane on the anode side is pressurized with electrolyte, rich with hydrogen fluoride. Pressure $P_m$ in the cavity 44 is about two inches of water higher than pressure $P_a$ in the anode compartment, and pressure $P_c$ in the cathode compartment, so that the electrolyte is forced out of chamber 44 to the anode and cathode compartments and prevents flow in the reverse direction.

FIGS. 4 and 5 illustrate the distance d between the two electrodes at any point on the surface of the electrodes. "a" is cavity space plus the membrane thickness, and d is the distance from the membrane 44 to any point on the surface of the electrode element 22 or electrode element 34. "a" is less than 0 or as high as 50 mm. The distance a+d is the distance between the two electrodes at any point on an anode electrode with respect to the corresponding cathode electrode. The distance d is equal to L/2 times the cosine of angle alpha, where L is the width of the electrode element, and alpha is the angle with respect to the vertical axis or side of the compartment.

The present invention has the advantage of operating with a high-pressure differential between the anode and cathode compartments and maintaining the proper concentration of electrolyte in contact with the electrodes by replacing it with fresh electrolyte solution preadjusted before entering the pressurized membrane cavity.

In addition, the double membrane acts as a safeguard for preventing recombination of fluorine and hydrogen and provides better electrical insulation between the anode and cathode. Further, the new electrolyzer provides a neutral enclosure without sacrificing the insulation for the cathode electrical feed.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. An electrolytic gas generator, comprising:

a) at least one anode compartment for receiving electrolyte having a vertically-disposed anode side;

b) a plurality of anode electrodes in said at least one anode compartment being mounted at an angle alpha relative to said anode side;

c) said angle alpha being between 15° and 75°;

d) at least one cathode compartment for receiving electrolyte having a vertically-disposed cathode side;

c) a plurality of cathode electrodes in said at least one cathode compartment being mounted at an angle beta relative to said cathode side;

f) said angle beta being between 15° and 75°;

g) an electrolyte-feeding compartment disposed between said at least one anode compartment and said at least one cathode compartment for supplying electrolyte to both said anode compartment and said cathode compartment; and h) said electrolyte-feeding compartment includes an anode membrane through which electrolyte passes to said anode compartment, a cathode membrane through which electrolyte passes to said cathode compartment, and an electrolyte-feeding chamber for holding electrolyte therein under pressure and disposed between said anode and cathode membranes.

2. An electrolytic gas generator in accordance with claim 1, wherein there are two anode compartments, and said at least one cathode compartment is disposed between said two anode compartments in a side-by-side manner.

3. An electrolytic gas generator in accordance with claim 1, further including means for maintaining under pressure the electrolyte supplied to said electrolyte-feeding chamber, so that the pressure therein is higher than the pressure in said anode and cathode compartments.

4. An electrolytic gas generator in accordance with claim 1, wherein said plurality of anode electrodes are mounted at said angle alpha relative to said anode membrane and in close proximity to said anode membrane, and wherein said plurality of cathode electrodes are mounted at said angle beta relative to said cathode membrane and in close proximity to said cathode membrane.

5. An electrolytic gas generator in accordance with claim 1, wherein said anode compartment includes an anode gas-receiving zone disposed above said plurality of anode electrodes for collecting the anode gas produced by said anode electrodes, and a cathode gas-receiving zone disposed above said plurality of cathode electrodes for collecting the cathode gas produced by said cathode electrodes.

6. An electrolytic gas generator in accordance with claim 5, wherein said anode gas zone is enclosed only by metal.

7. An electrolytic gas generator in accordance with claim 6, wherein said anode compartment is completely insulated from said cathode compartment and also from said electrolyte-feeding compartment, and by electric insulation material.

8. An electrolytic gas generator in accordance with claim 5, further including an electrical insulator disposed between said cathode gas-receiving zone and said plurality of cathode electrodes.

9. An electrolytic gas generator in accordance with claim 1, wherein said cathode electrodes are formed of flat steel bars and produce molecular hydrogen gas, and wherein said anode electrodes are formed of a nickel alloy and produce molecular fluorine gas.

10. An electrolytic gas generator in accordance with claim 1, further including means for supplying electrolyte to said anode and cathode compartments, and said electrolyte is anhydrous liquid hydrogen fluoride for producing molecular hydrogen gas and molecular fluorine gas.

11. An electrolytic gas generator in accordance with claim 1, wherein said anode and cathode membranes are porous perfluorinated material, and each is less than 3 mm in thickness.

12. An electrolytic gas generator in accordance with claim 1, wherein said anode electrodes each has a length L of 0.1 m to 10 m and a width W of 1 cm to 10 cm and a thickness of 1 mm to 10 mm.

13. An electrolytic gas generator in accordance with claim 1, wherein said cathode electrodes each has a length L of 0.1 m to 10 m and a width W of 1 cm to 10 cm and a thickness of 1 mm to 10 mm.

14. An electrolytic gas generator in accordance with claim 1, wherein said anode and cathode electrodes are spaced apart by a distance R equal to d+a, and wherein a is less than zero or as high as 50 mm, and wherein said anode and cathode electrodes are vertically staggered relative to each other.

15. An electrolytic gas generator, comprising:

a) a cathode compartment for receiving electrolyte having a first side and a second side, a first plurality of cathode electrodes disposed at an angle beta relative to said first side, a second plurality of cathode electrodes disposed at an angle beta relative to said second side, and a cathode gas-receiving zone disposed above said cathode electrodes;

b) a first anode compartment for receiving electrolyte adjacent to said first side, a first plurality of anode electrodes disposed at an angle alpha relative to said first side, and a first anode gas-receiving zone disposed above said first plurality of anode electrodes;

c) a second anode compartment for receiving electrolyte adjacent to said second side, a second plurality of anode electrodes disposed at an angle alpha relative to said second side, and a second anode gas-receiving zone disposed above said second plurality of anode electrodes;

d) a first electrolyte-feeding compartment disposed between said cathode compartment and said first anode compartment, and a second electrolyte-feeding compartment disposed between said cathode compartment and said second anode compartment, for supplying electrolyte to said cathode compartment and to said first and second anode compartments;

e) each of said first and second electrolyte-feeding compartments having an electrolyte-feeding chamber for holding electrolyte therein under pressure to form a pressurized electrolyte-feeding chamber, a cathode membrane through which said electrolyte under pressure passes to said cathode compartment to react with said cathode electrodes, and an anode membrane through which said electrolyte under pressure passes to one of said first and second anode compartments; and f) means for maintaining under pressure said electrolyte within said first and second electrolyte-feeding chambers, so that the pressure therein is higher than the pressure in said cathode compartment and said first and second anode compartments.

16. An electrolytic gas generator in accordance with claim 15, wherein said cathode electrodes are formed of flat steel bars and produce molecular hydrogen gas, and wherein said anode electrodes are formed of a nickel alloy and produce molecular fluorine gas, and wherein said electrolyte is anhydrous liquid hydrogen fluoride.

17. An electrolytic gas generator in accordance with claim 15, wherein said anode and cathode membranes are porous perfluorinated material, and each is less than 3 mm in thickness.

18. An electrolytic gas generator in accordance with claim 15, wherein said anode and cathode electrodes each has a length L of 0.1 m to 10 m and a width W of 1 cm to 10 cm and a thickness of 1 mm to 10 mm.

19. An electrolytic gas generator in accordance with claim 15, wherein said anode and cathode electrodes are spaced apart by a distance R equal to d +a, and wherein a is less than zero or as high as 50 mm, and wherein said anode and cathode electrodes are vertically staggered relative to each other.

20. An electrolytic gas generator, comprising:

a) at least one anode compartment and at least one cathode compartment each for receiving electrolyte;

b) a plurality of anode electrodes in said at least one anode compartment;

c) a plurality of cathode electrodes in said at least one cathode compartment;

d) an electrolyte-feeding compartment disposed between said at least one anode compartment and said at least one cathode compartment for supplying electrolyte to both said anode compartment and said cathode compartment; and e) said electrolyte-feeding compartment including an node membrane through which electrolyte passes to said anode compartment, a cathode membrane through which electrolyte passes to said cathode compartment, and an electrolyte-feeding chamber for holding electrolyte therein under pressure and disposed between said anode and cathode membranes.

21. An electrolytic gas generator in accordance with claim 20, further including means for maintaining under pressure the electrolyte supplied to said electrolyte-feeding chamber, so that the pressure therein is higher than the pressure in said anode and cathode compartments.

22. An electrolytic gas generator in accordance with claim 20, wherein said plurality of anode electrodes are mounted at an angle of between 15° and 75° relative to said anode membrane, and wherein said plurality of cathode electrodes are mounted at an angle of between 15° and 75° relative to said cathode membrane.

23. An electrolytic gas generator in accordance with claim 20, wherein said cathode electrodes are formed of flat steel bars and produce molecular hydrogen gas, and wherein said anode electrodes are formed of a nickel alloy and produce molecular fluorine gas, and wherein said electrolyte is anhydrous liquid hydrogen fluoride.

24. An electrolytic gas generator in accordance with claim 20, wherein said anode and cathode membranes are porous perfluorinated material, and each is less than 3 mm in thickness.

* * * * *

UNITED STATES PATENT AND TRADEMARK OFFICE

CERTIFICATE OF CORRECTION

PATENT NO. : 5,366,606

DATED : November 22, 1994

INVENTOR(S) : Gregorio Tarancon

It is certified that error appears in the above-identified patent and that said Letters Patent is hereby corrected as shown below:

Column 1, line 65, change "he" to --the--.

Column 3, line 29, change "he" to --the--.

Column 4, line 2, change "oat" to --part--.

Column 5, line 39, change "c)" to --e)--.

Column 8, line 18, change "node" to --anode--.

Signed and Sealed this

Twenty-eight Day of February, 1995

*Attest:*

*Attesting Officer*

Bruce Lehman

BRUCE LEHMAN

*Commissioner of Patents and Trademarks*